US005832726A

United States Patent [19]

Rees et al.

[11] Patent Number: 5,832,726

[45] Date of Patent: Nov. 10, 1998

[54] INTERNAL COMBUSTION ENGINE ASSEMBLY

[75] Inventors: Douglas James Rees, New Carlisle, Ohio; Marold William Lavy, Oklahoma City, Okla.

[73] Assignee: Cooper Cameron Corporation, Houston, Tex.

[21] Appl. No.: 788,657

[22] Filed: Jan. 24, 1997

[51] Int. Cl.[6] ..... F01N 7/00

[52] U.S. Cl. ..... 60/322; 181/243

[58] Field of Search ..... 60/322; 181/243, 181/236

[56] References Cited

U.S. PATENT DOCUMENTS

| | | | |
|---|---|---|---|
| 731,079 | 6/1903 | Steiner | 110/184 |
| 3,401,774 | 9/1968 | Krahn | 285/322 |
| 3,814,036 | 6/1974 | Fanton | 110/184 |
| 3,815,965 | 6/1974 | Ostwald | 417/237 |
| 4,133,547 | 1/1979 | Fox | 180/541 A |
| 4,719,752 | 1/1988 | Hall | 60/322 |

FOREIGN PATENT DOCUMENTS

| | | |
|---|---|---|
| 1230889 | 5/1986 | U.S.S.R. . |
| 1798218 | 2/1993 | U.S.S.R. . |

*Primary Examiner*—Thomas E. Denion
*Attorney, Agent, or Firm*—Frohwitter

[57] ABSTRACT

An internal combustion engine assembly comprises an internal combustion engine and an exhaust assembly connected to an exhaust outlet of the engine. The exhaust assembly comprises: an exhaust pipe having an inlet end connected to the exhaust outlet of the engine and an outlet end; a generally cylindrical muffler having a central longitudinal axis, the muffler having an inlet end and an outlet end; and a muffler support having a pivot; the muffler having an operating position, in which operating position the said axis of the muffler is substantially vertical and the inlet end of the muffler is in gas flow communication with the outlet end of the exhaust pipe, and a storage position, in which the said axis of the muffler is substantially horizontal. The muffler is connected to and arcuately movable about the pivot of the muffler support between the operating position and the storage position.

21 Claims, 7 Drawing Sheets

INTERNAL COMBUSTION ENGINE ASSEMBLY

TECHNICAL FIELD OF THE INVENTION

This invention relates to an internal combustion engine assembly comprising an exhaust system for the engine, the exhaust system comprising a muffler.

BACKGROUND OF THE INVENTION

It is well known and established to provide internal combustion engines with exhaust systems, in particular exhaust systems including mufflers. Typically, the exhaust system, including all the lengths of exhaust pipe, together with the muffler, is of a rigid, fixed configuration.

Russian patent publication No. SU 1798218 discloses an airport maintenance vehicle driven by an internal combustion engine having a vertical exhaust stack connected by a pipe to the engine. The vehicle has an additional length of exhaust stack which is hinged at its joint with the vertical exhaust stack. When the vehicle is in motion, the additional length of exhaust stack is hinged down onto the roof of the vehicle. When it is desired to operate the engine with the vehicle stationary for any prolonged period of time, the additional length of exhaust stack is erected. This is described as more effectively dispersing the exhaust fumes from the area of the parked vehicle.

Russian patent publication No. SU 1230889 discloses a motor vehicle having an internal combustion engine. The exhaust system of the engine comprises an exhaust system with a fixed exhaust pipe and an intermediate muffler. The muffler contains an integral heat exchanger for providing heat to the interior of the vehicle. The heat transfer medium used is water and, in order to enable the heat exchanger in the muffler to be filled with water, the muffler is mounted on a pivot and can be temporarily raised from its generally horizontal operating position. The muffler is connected at its outlet end to the exhaust pipe by means of a flexible hose in order to allow the muffler to move.

SUMMARY OF THE INVENTION

According to the present invention there is provided an internal combustion engine assembly comprising an internal combustion engine and having an exhaust assembly connected to an exhaust outlet of the engine, the exhaust assembly comprising an exhaust pipe having an inlet end connected to the exhaust outlet of the engine and an outlet end;

a muffler having an inlet end and an outlet end; and a muffler support;

the muffler having an operating position, in which operating position the inlet end of the muffler is in gas flow communication with the outlet end of the exhaust pipe, and a storage position, the muffler being connected to and movable about the muffler support between the operating position and the storage position.

In the operating position, the muffler is in a position to allow the engine to be run safely, with the exhaust gases being expelled at a suitable location. The storage position of the muffler is intended for periods of storage and transport of the engine assembly. The muffler may remain in the storage position for prolonged periods of time, but it is not appropriate for the engine to be operated in this mode. Indeed, in a preferred embodiment, the muffler is not connected to the exhaust pipe of the engine when in the storage position.

The present invention is particularly advantageous when applied to large stationary internal combustion engines, for example engine and compressor units employed to compress gases, for example gas at oil well heads. Such units need to be readily transportable and easily erected and placed in operating order. Typically, such units preferably employ large, long mufflers in order to disperse the exhaust gases at a safe height above the engine. However, to date, the transportation of such units without dismantling the muffler section has not been possible, due to restrictions in the maximum height of a load which can be transported by road or rail. The internal combustion engine assembly of the present invention is a compact unit with the muffler in the storage position allowing easy transport. However, with the muffler in the operating position, the height needed in order to meet exhaust emissions requirements can easily be met.

It will be appreciated that the present invention, while particularly suitable for use in connection with the stationary engines referred to above, is not limited in such use and is generally applicable to a wide range and size of internal combustion engine.

The inlet end of the muffler may remain in gas flow communication with the outlet end of the exhaust pipe when the muffler is in the storage position, for example by means of a flexible pipe. However, it is preferred to provide the muffler and the exhaust pipe with rigid connection means and to allow the inlet end of the muffler to separate from the outlet end of the exhaust pipe when the muffler is moved from the operating position to the storage position.

In a preferred embodiment, the muffler support comprises a pivot about which the muffler moves arcuately between the operating position and the storage position. The muffler preferably comprises biassing means, such as a counterweight, to bias it into the operating position. With such biassing means, it is preferred, in particular when employing large, heavy mufflers, to provide means to control the movement of the muffler from the storage position to the operating position and means to return the muffler to the storage position against the bias.

It is preferred that the muffler support is separate from the exhaust pipe, thus allowing the muffler to be supported without any weight coming to bear on the exhaust pipe. In this way, cracking of the exhaust pipe or the muffler due to stress is eliminated. The muffler support is preferably in two portions, a first portion providing support for the muffler during movement between the operating position and the storage position and while the muffler is in the storage position, and a second portion supporting the muffler once it is in the operating position. In a preferred embodiment, the second support portion provides support for the entire weight of the muffler when the muffler is in the operating position. The second support portion is conveniently mounted to and movable with the muffler. It is preferred that the second support portion is adjustable in height, to cater for unevenness in the surface on which the engine assembly is standing. In addition, a muffler storage support is preferably provided in order to provide support for the muffler when in the storage position.

Thermal expansion of the muffler and associated pipes can lead to movement of the muffler relative to the other parts of the engine assembly. Accordingly, it is preferred to allow for movement of the muffler due to such expansion. This is most preferably achieved by means of a floating pivot in the muffler support. References to a "floating pivot" are to a pivot arrangement in which the muffler is free or may be rendered free to move linearly with respect to the pivot point.

A lock is preferably provided in order to secure the muffler in the storage position.

BRIEF DESCRIPTION OF THE DRAWINGS

Embodiments of the present invention will now be described by way of example only having reference to the accompanying drawings, in which.

It is to be noted, however, that the appended drawings illustrate only typical embodiments of the present invention and are therefore not to be considered a limitation of the scope of the invention which includes other equally effective embodiments.

DESCRIPTION OF THE PREFERRED EMBODIMENTS OF THE INVENTION

Figure 1:
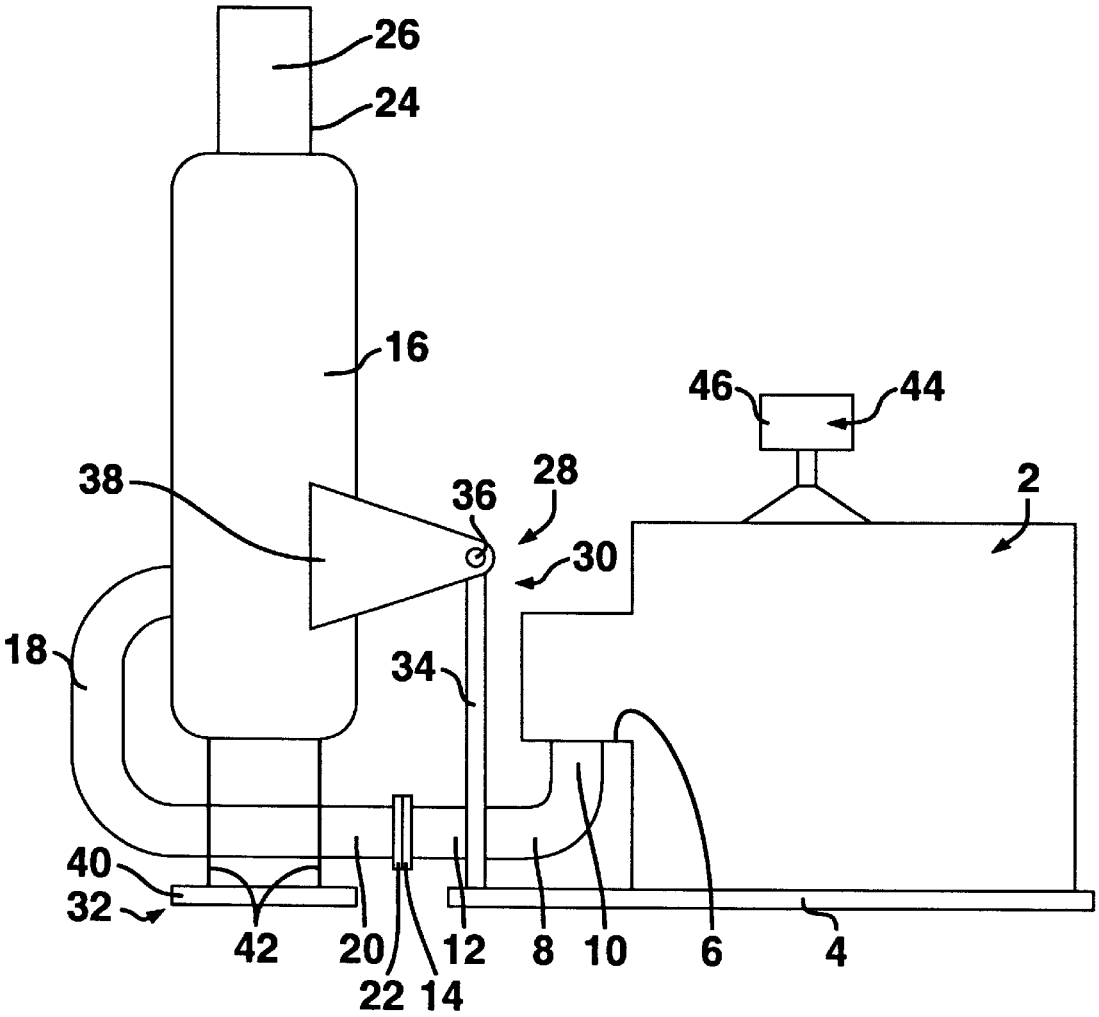
FIG. 1 is a diagrammatic illustration of a first embodiment of the internal combustion engine assembly of the present invention in which the muffler is in the operating position.

Referring to FIG. 1, a stationary internal combustion engine, generally represented as 2, is supported on a base plate 4, commonly referred to as a skid. The engine is typical of the type of engine required to be transported to different locations to provide power for various duties, for example driving a compressor for use in the compression of associated gas at an oil well head. The base plate 4 is weighted by being filled with concrete.

The engine 2 comprises an exhaust outlet 6, from which an exhaust pipe 8 extends. The exhaust pipe 8 has an inlet end 10 connected to the exhaust outlet 6 of the engine 2. The exhaust pipe 8 extends from the exhaust outlet 6 first towards and then parallel to the base plate 4 and terminates at its outlet end 12 in a flange 14.

A muffler 16 is provided and is shown in FIG. 1 in its operating position. The muffler is generally cylindrical in shape having a central longitudinal axis which, in the operating position is oriented substantially vertically. The muffler comprises an inlet pipe 18 having an inlet end 20 terminating in a flange 22. In the operating position shown, the flange 22 of the inlet pipe 18 of the muffler 16 mates with the flange 14 at the outlet end 12 of the exhaust pipe 8. The flanges 14 and 22 are mated with a suitable sealing device, such as a gasket (not shown), and bolted or clamped together so as to form a gas-tight seal for the flow of exhaust gases from the exhaust outlet 6 of the engine 2 to the muffler 16. The muffler 16 comprises an outlet end 24 having an outlet pipe 26. The combined height of the muffler 16 and the outlet pipe 26 are such as to disperse the exhaust gases from the engine 2 during operation at a sufficient height above the ground and personnel working around the engine.

A muffler support is provided, generally indicated as 28 in FIG. 1, which, together with the base plate 4, supports the muffler 16. The muffler support 28 comprises two portions, a first, pivot portion, generally indicated as 30, and a second, support portion, generally indicated as 32. The pivot portion 30 of the muffler support 28 comprises a pair of struts 34 extending vertically upwards from the base plate 4 either side of the exhaust pipe 8. The upper end of each strut 34 is provided with a circular opening, through which a pivot pin 36 extends parallel with the base plate 4. The openings in the struts 34 may be provided with bearings to facilitate rotation of the pivot pin 36. The muffler 16 has a generally triangular plate 38 mounted upon each side, each plate 38 being mounted to the muffler 16 along one side and extending towards and connected to a respective end of the pivot pin 36. The plates 38, and thus the muffler 16 to which they are mounted, are rotatable about the pivot formed by the pivot pin 36 rotating in the upper ends of the struts 34.

The support portion 32 of the muffler support 28 comprises a muffler base plate 40, connected to the lower portion of the muffler by support struts 42. In the operating position shown in FIG. 1, the weight of the muffler 16 is supported by the combination of the pivot portion 30 and the support portion 32 of the muffler support 28. This eliminates the stresses on the exhaust pipe 8 and the inlet pipe 18 of the muffler, in turn reducing the occurrence of cracking of the pipes and prolonging the operating life of the engine. To ensure that the entire weight of the muffler 16 is supported by the muffler support 28 and that minimal force bears on the exhaust pipe 8 or the muffler inlet pipe 18, the support struts 42 of the support portion 32 of the muffler support 28 are preferably adjustable, for example by means of screw adjusters (not shown). The muffler base plate 40 may be weighted, for example by means of concrete, in order to provide a counterweight to bias the muffler 16 into the operating position.

The engine 2 further comprises a muffler storage support, generally indicated as 44, comprising a curved support plate 46 having a curvature matching that of the respective portion of the muffler 16. The muffler storage support is mounted on the top of the engine 2.

Figure 2:
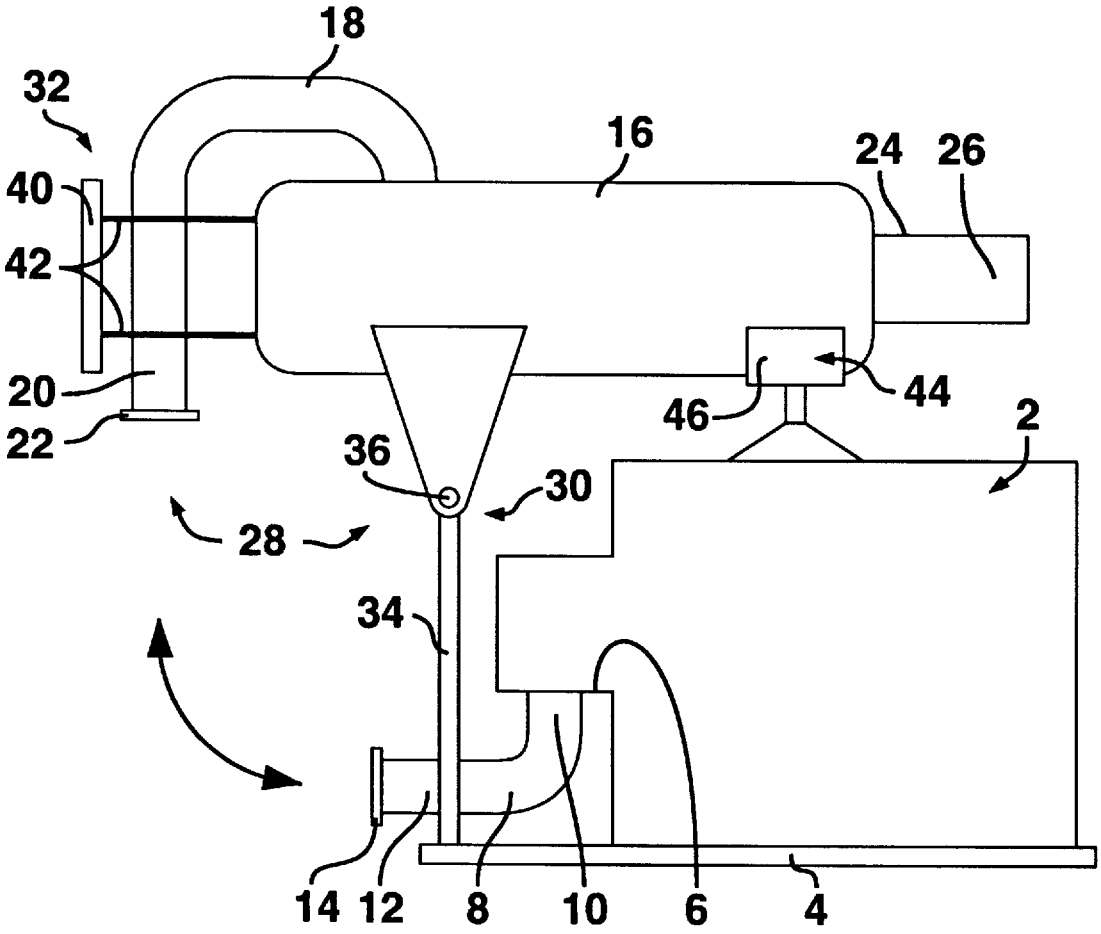
FIG. 2 is a diagrammatic illustration of the engine assembly of FIG. 1, but with the muffler in the storage position.

Referring to FIG. 2, the engine of FIG. 1 is shown with the muffler 16 in he storage position. Once operation of the engine 2 has been stopped, any means mating the flanges 14 and 22 connecting the exhaust pipe 8 with the muffler inlet pipe 18 may be removed and the muffler, complete with the support portion 32 of the muffler support 28, rotated about the pivot pin 36 from the vertical operating position into the storage position. In the storage position, the muffler 16 lies across the top of the engine 2 with its central longitudinal axis substantially horizontal. The muffler 16 rests on and is supported by the support plate 46 of the muffler storage support 44. A lock (not shown), for example comprising one or more bolts, can be provided in the muffler storage support 44 in order to secure the muffler 16 in the storage position.

Once the muffler is secured in the storage position, the engine is in a condition to be transported. This may be achieved, for example, by loading the base plate 4, together with the engine 2 and muffler 16 onto the bed of a truck by means of a crane or hoist.

Figure 3:
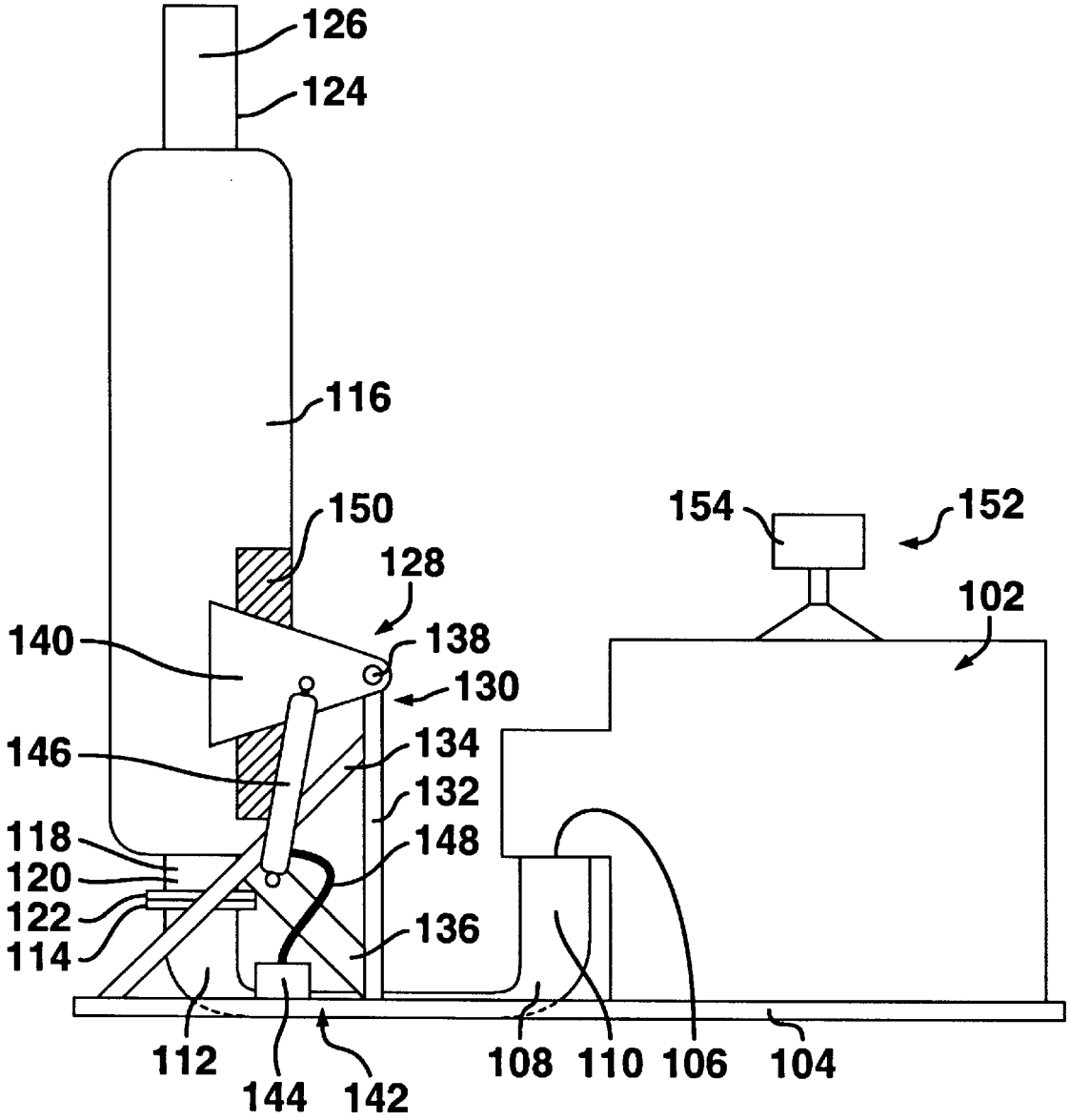
FIG. 3 is a diagrammatic illustration of a second embodiment of the internal combustion engine assembly of the present invention in which the muffler is in the operating position.

FIG. 3 shows a second embodiment of the present invention, again with the muffler in the operating position. Referring to FIG. 3, a stationary internal combustion engine, generally represented as 102, is supported on a base plate 104, commonly referred to as a skid. The base plate 104 is weighted by being filled with concrete. The engine comprises a muffler 116. The base plate 104 extends beneath both the engine 102 and the muffler 116.

The engine 102 comprises an exhaust outlet 106, from which an exhaust pipe 108 extends. The exhaust pipe 108 has an inlet end 110 connected to the exhaust outlet 106 of the engine 102. The exhaust pipe 108 extends from the exhaust outlet 106 and horizontally in a channel in the base plate 104 (indicated by the broken lines in FIG. 3) and terminates at its outlet end 112 in a flange 114.

The muffler 116 is shown in FIG. 3 in its operating position. The muffler 116 is generally cylindrical in shape having a central longitudinal axis which, in the operating position is oriented substantially vertically. The muffler 116 comprises an inlet pipe 118 extending vertically down from its lower end, as oriented in the operating position, having an inlet end 120 terminating in a flange 122. In the operating position shown, the flange 122 of the inlet pipe 118 of the muffler 116 mates with the flange 114 at the outlet end 112 of the exhaust pipe 108. In contrast to the embodiment of FIG. 1, the exhaust pipe 108 and the muffler inlet pipe 118 are formed with the joint formed by the flanges 114 and 122 in the horizontal plane. The flanges 114 and 122 are mated with a suitable sealing device, such as a gasket (not shown), and bolted or clamped together so as to form a gas-tight seal for the flow of exhaust gases from the exhaust outlet 106 of the engine 102 to the muffler 116. The muffler 116 comprises an outlet end 124 having an outlet pipe 126. As with the embodiment of FIG. 1, the combined height of the muffler 116 and the outlet pipe 126 are such as to disperse the exhaust gases from the engine 102 during operation at a sufficient height above the ground and personnel working around the engine.

A muffler support is provided, generally indicated as 128. The muffler support 128 of the embodiment of FIG. 3 comprises a single, pivot portion, generally indicated as 130. The pivot portion 130 of the muffler support 128 comprises a pair of struts 132 extending vertically upwards from the base plate 104. The muffler support 128 further comprises a pair of diagonal bracing struts 134 one each extending from the upper portion of the support struts 132 to the respective end portion of the base plate 104. A bracing plate 136 extends from the center of each diagonal bracing strut 134 to the respective support strut 132 at the junction of the support strut 132 and the base plate 104. The upper end of each strut 132 is provided with a circular opening, through which a pivot pin 138 extends parallel with the base plate 104. The openings in the struts 132 may be provided with bearings to facilitate rotation of the pivot pin 138. The muffler 116 has a generally triangular plate 140 mounted upon each side, each plate 140 mounted to the muffler 116 along one side and extending towards and connected to a respective end of the pivot pin 138. The plates 140, and thus the muffler 116 to which they are mounted, are rotatable about the pivot formed by the pivot pin 138 rotating in the upper ends of the struts 132.

In this embodiment of the invention, when the muffler 116 is in the operating position, the weight of the muffler is supported by both the muffler support 128 and the outlet end 112 of the exhaust pipe 108 by means of the flange 114.

A hydraulic system, generally indicated as 142, is provided in order to rotate the muffler 116 about the pivot pin 138 between the operating position and the storage position. The hydraulic system 142 comprises a hydraulic pump 144 mounted on the base plate 104. A lift cylinder 146 has one end rotatably connected to a bracing plate 136 in the region adjacent its connection with the respective bracing strut 134. The second end of the lift cylinder 146 is rotatably connected to the corresponding triangular plate 140 at a mid point between the muffler 116 and the pivot pin 138. A hydraulic hose 148 connects the hydraulic pump 144 with the lift cylinder 146. Extension of the lift cylinder 146 rotates the triangular plate 140 and the muffler 116 about the pivot formed by the pivot pin 138 from the operating position to the storage position. Retraction of the lift cylinder 146 moves the muffler 116 from the storage position into the operating position. It is preferred to provide the hydraulic pump 144 and the lift cylinder with releasable mountings, in order to allow the hydraulic system 142 to be removed from the engine once the muffler 116 has been raised into the operating position. This avoids damage to the hydraulic system occurring due to the heat released from the muffler 116 during operation of the engine 102.

The muffler 116 is provided with a layer of insulation 150 extending over the portion of the outer surface of the muffler between the triangular plates 140.

The engine 102 further comprises a muffler storage support, generally indicated as 152, comprising a curved support plate 154 having a curvature matching that of the respective portion of the muffler 116. The muffler storage support 152 is mounted on the top of the engine 102.

Figure 4:
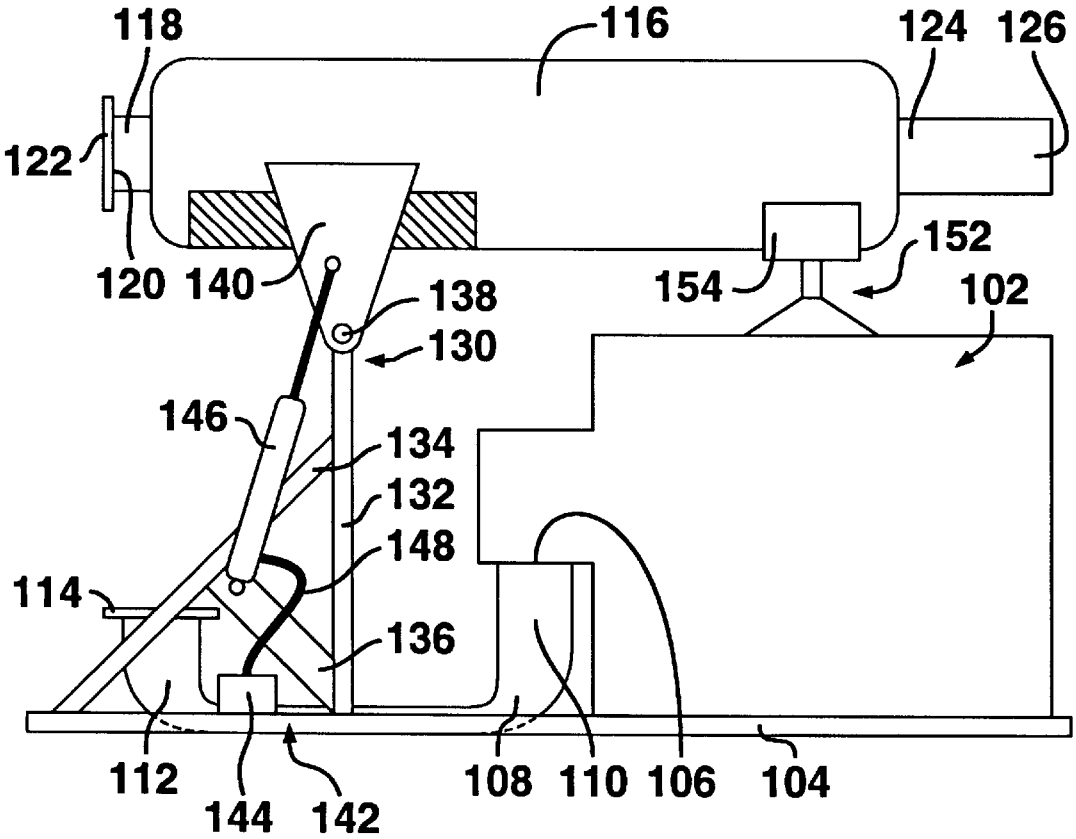
FIG. 4 is a diagrammatic illustration of the engine assembly of FIG. 3, but with the muffler in the storage position.

Referring to FIG. 4, the engine of FIG. 3 is shown with the muffler 116 in the storage position. Once operation of the engine 102 has been stopped, any means mating the flanges 114 and 122 connecting the exhaust pipe 108 with the muffler inlet pipe 118 may be removed. If removed before operation of the engine, the pump 144 and the lift cylinder 146, together with the associated hydraulic hose 148, are replaced before moving the muffler 116 can begin. The muffler 116 is rotated about the pivot pin 138 from the vertical operating position into the storage position. With the muffler 116 in the operating position, operation of the hydraulic system 142 forces hydraulic fluid into the lift cylinder 146, extending the cylinder and rotating the muffler 116 about the pivot pin 138 into the horizontal storage position. In the storage position, the muffler 116 lies across the top of the engine 102 with its central longitudinal axis substantially horizontal. The muffler 116 rests on and is supported by the support plate 154 of the muffler storage support 152. A lock (not shown), for example comprising one or more bolts, can be provided in the muffler storage support 152 in order to secure the muffler 116 in the storage position.

Once the muffler is secured in the storage position, the engine is in a condition to be transported. This may be achieved, for example, by loading the base plate 104, together with the engine 102 and muffler 116 onto the bed of a truck by means of a crane or hoist.

Figure 5:
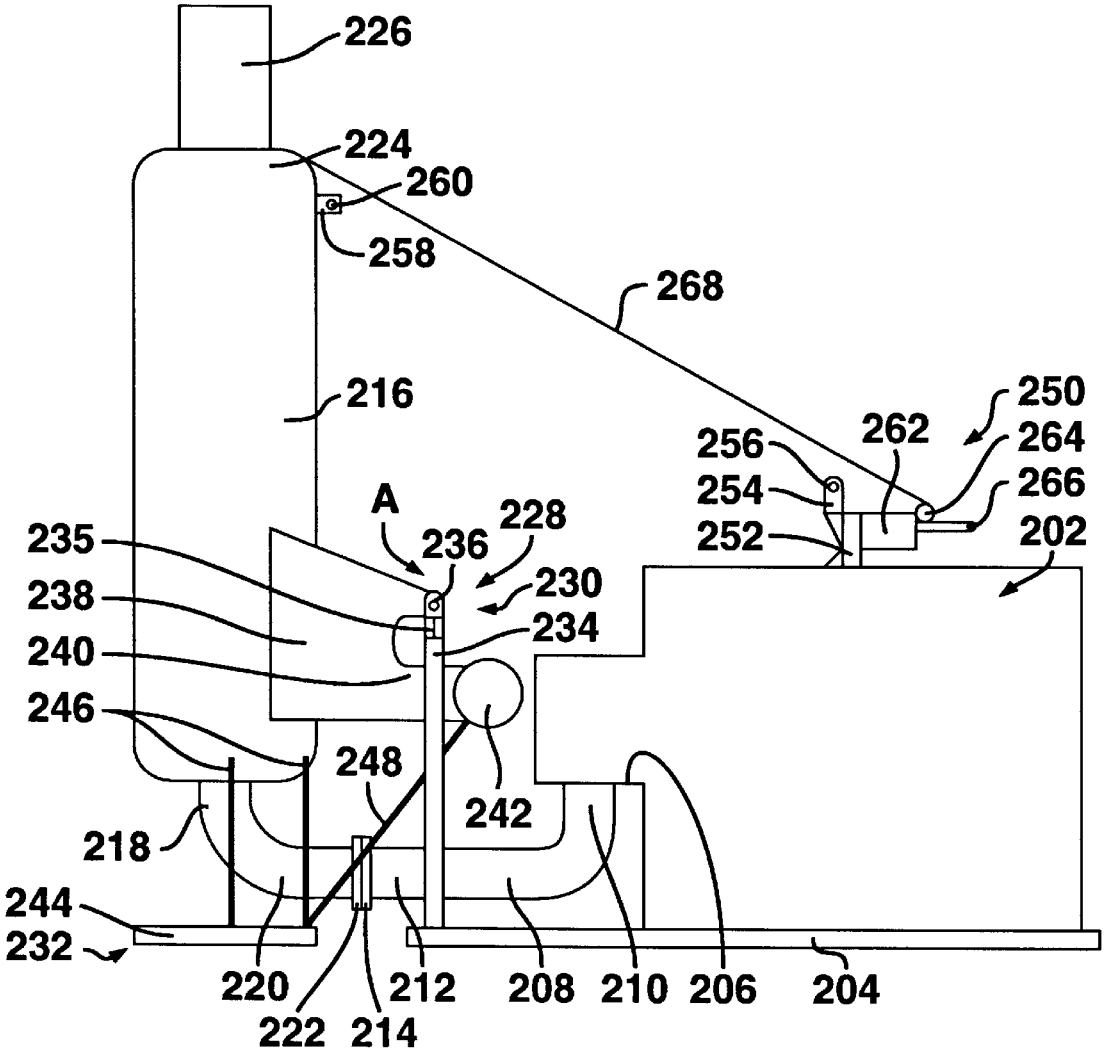
FIG. 5 is a diagrammatic illustration of a third embodiment of the internal combustion engine assembly of the present invention in which the muffler is in the operating position.

Referring to FIG. 5, a third embodiment of the present invention is shown. A stationary internal combustion engine, generally represented as 202, is supported on a base plate 204. The base plate 204 is weighted by being filled with concrete.

The engine 202 comprises an exhaust outlet 206, from which an exhaust pipe 208 extends. The exhaust pipe 208 has an inlet end 210 connected to the exhaust outlet 206 of the engine 202. The exhaust pipe 208 extends from the exhaust outlet 206 towards and then parallel to the base plate 204 and terminates at its outlet end 212 in a flange 214.

A muffler 216 is provided and is shown in FIG. 5 in its operating position. The muffler 216 is generally cylindrical in shape having a central longitudinal axis which, in the operating position is oriented substantially vertically. The muffler 216 comprises an inlet pipe 218 having an inlet end 220 terminating in a flange 222. In the operating position shown, the flange 222 of the inlet pipe 218 of the muffler 216 mates with the flange 214 at the outlet end 212 of the exhaust pipe 208. The flanges 214 and 222 are mated with a suitable sealing device, such as a gasket (not shown), and bolted or clamped together so as to form a gas-tight seal for the flow of exhaust gases from the exhaust outlet 206 of the engine 202 to the muffler 216. The muffler 216 comprises an outlet end 224 having an outlet pipe 226. The combined height of the muffler 216 and the outlet pipe 226 are such as to disperse the exhaust gases from the engine 202 during operation at a sufficient height above the ground and personnel working around the engine.

Figure 7:
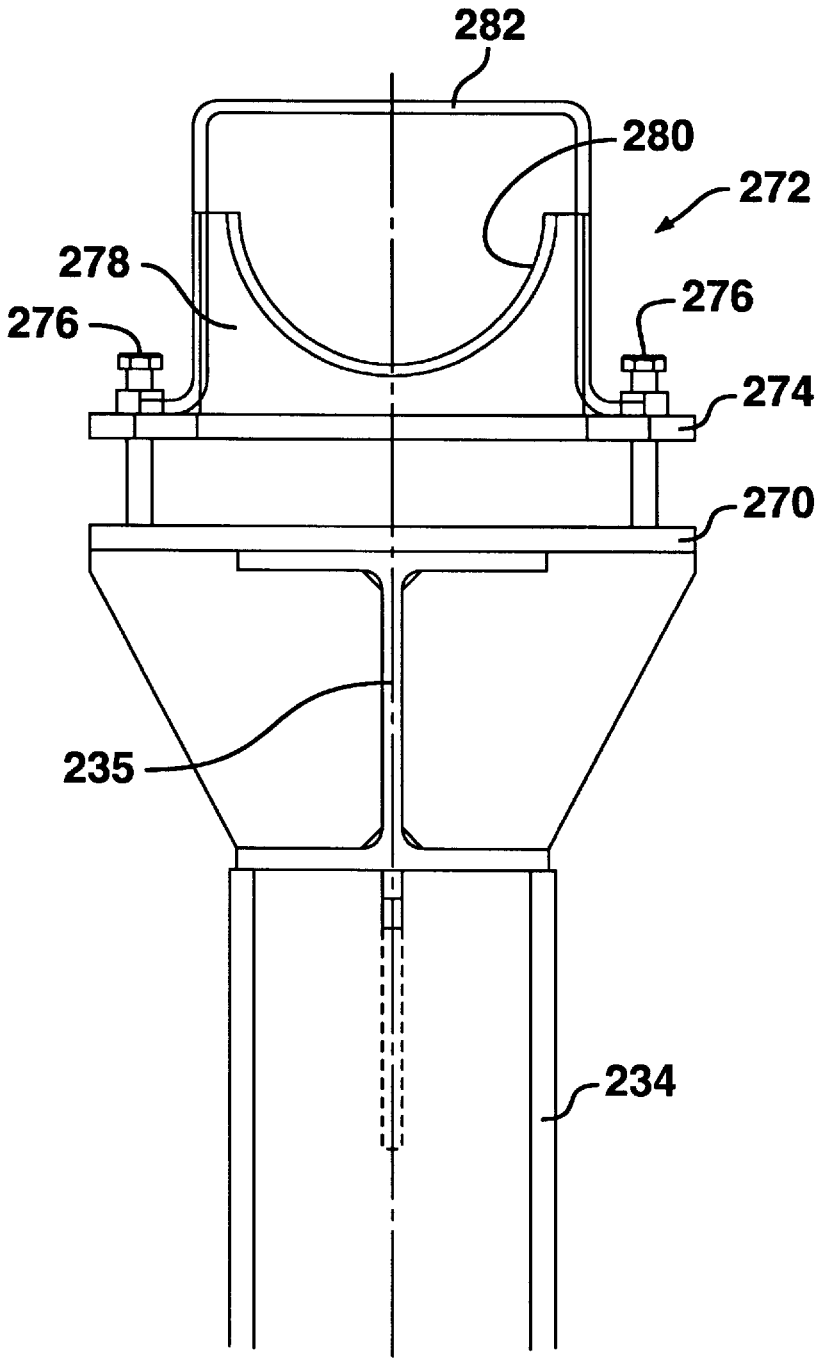
FIG. 7 is a detail of the floating pivot at point A in the assembly of FIG. 5.

A muffler support is provided, generally indicated as 228 in FIG. 5. The muffler support 228 comprises two portions, a first, pivot portion, generally indicated as 230, and a second, support portion, generally indicated as 232. The pivot portion 230 of the muffler support 228 comprises a pair of struts 234 extending vertically upwards from the base plate 204 either side of the exhaust pipe 208. The struts 234 are connected by a horizontal strut 235 mounted to the top of each strut 234. A pivot cradle 272 is mounted centrally on the horizontal strut 235. Details of the pivot cradle 272 are shown in FIG. 7 and described in detail hereinafter. A pivot pin 236 is secured in the pivot cradle 272 and is rotatable therein. The muffler 216 has a mounting plate 238 mounted upon each side, each plate 238 mounted to the muffler 216 along one side and extending towards and connected to a respective end portion of the pivot pin 236 between the two struts 234. The mounting plates 238, and thus the muffler 216 to which they are mounted, are rotatable about the pivot formed by the pivot pin 236 rotating in the pivot cradle 272. Each mounting plate 238 comprises a portion 240 extending perpendicular to the central longitudinal axis of the muffler 216. When the muffler 216 is in the operating position as shown in FIG. 5, the portion 240 of each mounting plate 238 extends between and beyond the two struts 234 towards the engine 202. A generally cylindrical counterweight 242 is mounted horizontally to and extends between the ends of the portions 240 of the two mounting plates 238. The counterweight 242 is of such weight as to bias the muffler 116 into the operating position shown in FIG. 5.

The support portion 232 of the muffler support 228 comprises a muffler base plate 244, connected to the lower portion of the muffler by support struts 246. Diagonal bracing struts 248 extend from the muffler base plate 244 to the counterweight 242. In the operating position shown in FIG. 5, the weight of the muffler 216 is supported by the support portion 232 of the muffler support 228 alone. This eliminates the stresses on the exhaust pipe 208 and the inlet pipe 218 of the muffler, in turn reducing the occurrence of cracking of the pipes and prolonging the operating life of the engine. To ensure that the entire weight of the muffler 216 is supported by the muffler support 228 and that minimal force bears on the exhaust pipe 208 or the muffler inlet pipe 218, the support struts 246 of the support portion 232 of the muffler support 228 are preferably adjustable, for example by means of screw adjusters (not shown). To enable the support struts 246 to be adjusted, the diagonal bracing struts 248 are removably connected to the muffler base plate 244. The diagonal bracing struts must be removed from the muffler base plate 244 prior to adjustment of the support struts 246.

The engine 202 further comprises a muffler storage support, generally indicated as 250 mounted on the top of the engine. The muffler storage support 250 comprises a storage support strut 252 extending vertically upwards from the engine 202. A lock is provided comprising a locking plate 254 extending upwards from the support strut 252 and having a hole 256 in its upper end portion. The lock further comprises a muffler locking plate 258 having a corresponding hole 260 and mounted on the outlet end 224 of the muffler 216. A winch 262 is mounted on the storage support strut 252 and comprises a spool 264 and a handle 266. A cable 268, wound on the spool 264, is attached to the outlet end 224 of the muffler 216.

Figure 6:
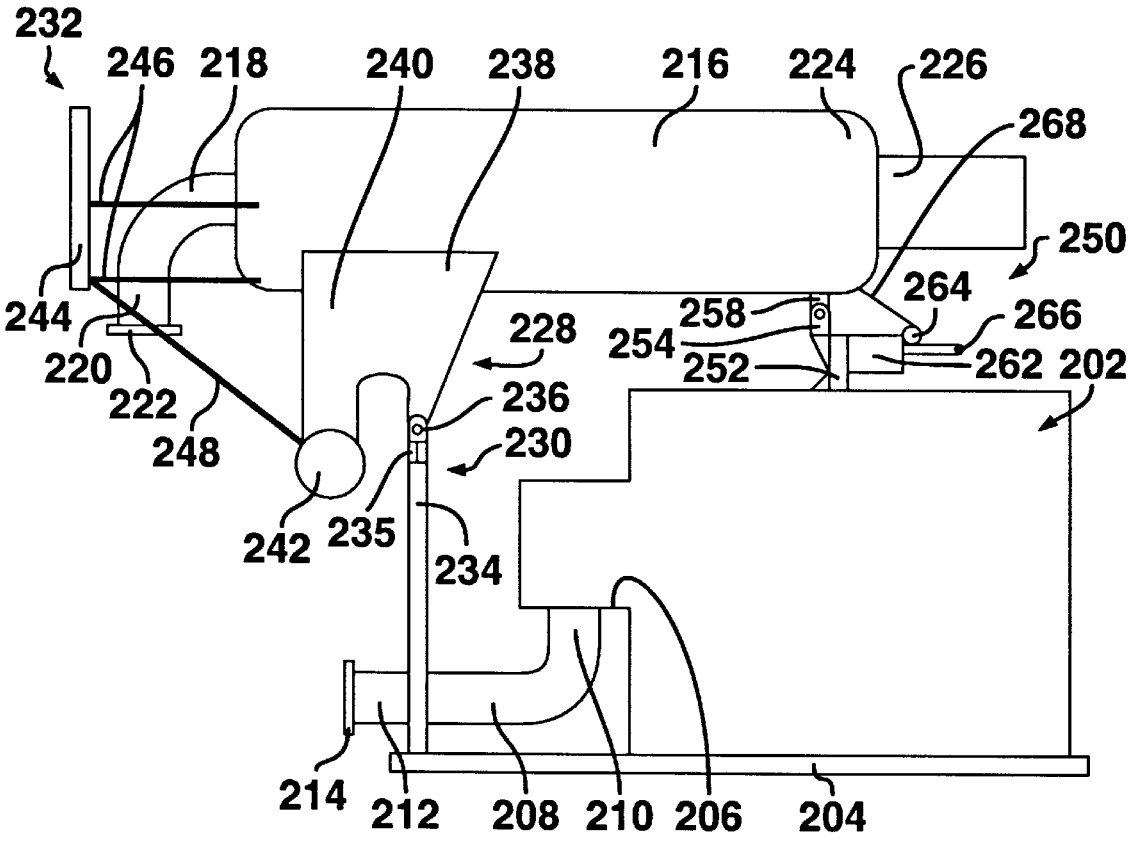
FIG. 6 is a diagrammatic illustration of the engine assembly of FIG. 5, but with the muffler in the storage position.

Referring to FIG. 6, the engine of FIG. 5 is shown with the muffler 216 in the storage position. Once operation of the engine 202 has been stopped, any means mating the flanges 214 and 222 connecting the exhaust pipe 208 with the muffler inlet pipe 218 may be removed and the muffler 216, complete with the support portion 232 of the muffler support 228, rotated about the pivot pin 236 from the vertical operating position into the storage position. Prior to rotation of the muffler 216, the diagonal bracing struts 248 are reconnected to the muffler base plate 244. Due to the position and weight of the counterweight 242 attached to the muffler 216, the muffler is biassed into the operating position as shown in FIG. 5. In order to return the muffler 216 to the storage position, the winch 262 is used to wind the cable 268 onto the spool 264 and pull the muffler 216 causing it rotate about the pivot pin 236. Once the muffler 216 is located in the storage position, the holes 256 and 260 in the muffler locking plate 254 and the muffler locking plate 258 respectively are aligned. A bolt or pin (not shown) is passed through both holes 256 and 260 to secure the muffler into the storage position. To return the muffler 216 to the operating position, the bolt or pin is removed from the holes 256 and 260. The winch 262 is used to control the biassing action of the counterweight 242 and allow the muffler 216 to return to the operating position.

Once the muffler 216 is located and locked in the storage position, the engine may be transported, for example on the flat bed of a truck.

During operation of the engine 202, heat will be generated causing the muffler 216 and the associated pipes to expand and move. It is therefore desirable to provide a means allowing the muffler to move, in order to maintain the muffler in the vertical operating position. Such means is preferably provided for in the pivot about which the muffler rotates between the operating position and the storage position. In order to allow the muffler 216 to move relative to the engine 202 and the exhaust pipe 208 due to thermal expansion of the muffler itself and the exhaust pipe 208, a floating pivot cradle is provided on the horizontal strut 235 extending between the struts 234. Details of the floating pivot cradle are shown in FIG. 7. The horizontal strut 235 has a pivot support plate 270 mounted on its upper surface at its mid point between the two struts 234. A pivot cradle is shown mounted on the pivot support plate 270 and is generally represented as 272. The pivot support cradle 272 comprises a cradle plate 274 secured to the pivot support plate 270 by means of bolts (not shown). Set screws 276 extend between the cradle plate 274 and the pivot support plate 270. Adjusting the set screws 276 varies the height of the cradle plate 274 and the height of the cradle 272 above the pivot support plate 270. The pivot support cradle 272 further comprises a pivot pin bearing 278 having a semi-circular bearing surface 280 (when viewed in cross-section), in which the pivot pin 236 (not shown in FIG. 7) will sit and rotate. A strap 282 is provided to retain the pivot pin in the pivot pin bearing 278.

In storage, the strap 282 is in place to retain the pivot pin 236 in contact with the bearing surface 280 of the pivot pin bearing 278. The set screws 276 are set to provide a significant distance between the cradle plate 274 and the pivot support plate 270. In this mode, the muffler 216 may be moved between the operating position and the storage position. Once it is desired to operate the engine 202 and the muffler is in the operating position, the strap 282 is removed. The support portion 232 of the muffler support 228 is adjusted as described above to support the entire weight of the muffler. The set screws 276 retaining the pivot support cradle 272 are adjusted to lower the cradle down onto the pivot support plate 270, thereby leaving the pivot pin 236, and hence the muffler 216, free to move in the vertical plane. Movement of the muffler 216 due to thermal expansion is thereby unrestrained.

As a further advantage, the inclusion of the set screws 276 in the pivot support cradle 272 allows for adjustment of the position of the pivot point for the muffler 216. This facilitates the replacement of the existing muffler 216 by a new muffler, should this be necessary, and allows for any minor irregularities in the sizing of the new muffler.

While the particular embodiments for the assembly of the present invention as herein disclosed in detail are fully capable of obtaining the objects and advantages herein stated, it is to be understood that they are merely illustrative of the presently preferred embodiments of the invention and that no limitations are intended by the details of construction or design herein shown other than as described in the appended claims.

What is claimed is:

1. An internal combustion engine assembly comprising an internal combustion engine and having an exhaust assembly connected to an exhaust outlet of the engine, the exhaust assembly comprising an exhaust pipe having an inlet end connected to the exhaust outlet of the engine and an outlet end;

a muffler having an inlet end and an outlet end; and a muffler support;

the muffler having an operating position, in which operating position the inlet end of the muffler is in gas flow communication with the outlet end of the exhaust pipe, and a storage position, the muffler being connected to and movable about the muffler support between the operating position and the storage position, the muffler comprising biasing means to bias the muffler into the operating position.

2. An internal combustion engine assembly as claimed in claim 1, wherein when the muffler is in the storage position the inlet end of the muffler is not in gas flow communication with the outlet end of the exhaust pipe.

3. An internal combustion engine assembly as claimed in claim 1, wherein the muffler is generally cylindrical and, in the operating position, is disposed with its central longitudinal axis substantially vertical.

4. An internal combustion engine assembly as claimed in claim 1, wherein the muffler is generally cylindrical and, in the storage position, is disposed with its central longitudinal axis substantially horizontal.

5. An internal combustion engine assembly as claimed in claim 1, wherein the muffler support comprises a pivot and the muffler is movable arcuately about the pivot between the operating position and the storage position.

6. An internal combustion engine assembly as claimed in claim 1, further comprising means to control the movement of the muffler from the storage position to the operating position and means to return the muffler to the storage position.

7. An internal combustion engine assembly as claimed in claim 5, comprising a hydraulic system to move the muffler between the operating position and the storage position.

8. An internal combustion engine assembly as claimed in claim 7, in which the hydraulic system comprises a hydraulic lift cylinder having a first end rotatably connected to the muffler support and a second end rotatably connected to the muffler and a hydraulic pump, the lift cylinder and the pump being removable once the muffler is in the operating position prior to operation of the engine.

9. An internal combustion engine assembly as claimed in claim 1, in which the muffler support is separate from the exhaust pipe.

10. An internal combustion engine assembly as claimed in claim 9, in which in the operating position the muffler support bears substantially the entire weight of the muffler.

11. An internal combustion engine assembly as claimed in claim 9, in which the muffler support comprises a first support portion, which supports the muffler in the storage position and during movement of the muffler between the operating position and the storage position, and a second support portion which supports the muffler in the operating position only.

12. An internal combustion engine assembly as claimed in claim 11, in which the second support portion is connected to and movable with the muffler.

13. An internal combustion engine assembly as claimed in claim 11, in which the second support portion is adjustable in height.

14. An internal combustion engine assembly as claimed in claim 11, in which the second support portion supports the entire weight of the muffler when the muffler is in the operating position.

15. An internal combustion engine assembly as claimed in claim 1, in which the muffler support comprises means for allowing movement of the muffler due to thermal expansion during operation of the engine with the muffler in the operating position.

16. An internal combustion engine assembly as claimed in claim 15, in which the said means comprises a floating pivot in the muffler support.

17. An internal combustion engine assembly as claimed in claim 1, further comprising a lock to retain the muffler in the storage position.

18. An internal combustion engine assembly as claimed in claim 1, in which the muffler support further comprises a muffler storage support to support the muffler when in the storage position.

19. An internal combustion engine assembly as claimed in claim 1, in which the engine is a stationary engine, the muffler support comprising a base supporting both the engine and the muffler.

20. An internal combustion engine assembly as claimed in claim 1, in which the engine is connected by a drive train to a compressor.

21. An internal combustion engine assembly comprising an internal combustion engine and an exhaust assembly connected to an exhaust outlet of the engine, the exhaust assembly comprising:

an exhaust pipe having an inlet end connected to the exhaust outlet of the engine and an outlet end;

a generally cylindrical muffler having a central longitudinal axis, the muffler having an inlet end and an outlet end; and a muffler support having a pivot; the muffler having an operating position, in which operating position the said axis of the muffler is substantially vertical and the inlet end of the muffler is in gas flow communication with the outlet end of the exhaust pipe, and a storage position, in which the said axis of the muffler is substantially horizontal, the muffler being connected to and arcuately movable about the pivot of the muffler support between the operating position and the storage position, the muffler comprising biasing means to bias the muffler into the operating position.

* * * * *